US007665442B1

(12) United States Patent
Levitz et al.

(10) Patent No.: US 7,665,442 B1
(45) Date of Patent: Feb. 23, 2010

(54) THROTTLE PLATE FOR USE WITH INTERNAL COMBUSTION ENGINE

(75) Inventors: John Levitz, Scottsdale, AZ (US); Sam Enloe, Phoenix, AZ (US)

(73) Assignee: Everaid Holdings, Inc., Phoenix, AZ (US)

( * ) Notice: Subject to any disclaimer, the term of this patent is extended or adjusted under 35 U.S.C. 154(b) by 0 days.

(21) Appl. No.: 12/422,478

(22) Filed: Apr. 13, 2009

(51) Int. Cl.
*F02B 31/00* (2006.01)
*F02M 29/00* (2006.01)

(52) U.S. Cl. ..... 123/306; 123/184.21; 123/184.53; 123/337; 123/556; 123/590; 48/189.4; 261/79.1; 138/37; 138/39

(58) Field of Classification Search ..... 123/184.21, 123/184.53, 306, 337, 590, 592, 556; 48/189.4; 261/79.1; 138/37, 39
See application file for complete search history.

(56) References Cited

U.S. PATENT DOCUMENTS 3,077,391 A * 2/1963 Guffra ..... 48/189.4
4,015,574 A 4/1977 Hanff
4,233,945 A * 11/1980 Beitz ..... 123/585
4,274,386 A 6/1981 Reyes
4,362,143 A * 12/1982 Fukumoto ..... 123/556
5,758,614 A 6/1998 Choi
6,338,335 B1 1/2002 Patterson et al.
7,086,498 B2 * 8/2006 Choi et al. ..... 181/270
2008/0041352 A1 2/2008 Bolanos

OTHER PUBLICATIONS

V-Twin Manufacturing 2009 Catalog, p. 664, viewable on World Wide Web at http://www.vtwinmfg.com/NewVtwinWeb/index.html.

* cited by examiner

*Primary Examiner*—Stephen K Cronin
*Assistant Examiner*—J. Page Hufty
(74) *Attorney, Agent, or Firm*—Etherton Law Group, LLC; Sandra L. Etherton; AnnMarie W. Whitley

(57) ABSTRACT

A throttle plate for use with internal combustion engines comprised of a relatively thin piece of material so that installation of the throttle plate between the carburetor or throttle body and intake manifold of a vehicle does not require additional brackets or components to correct throttle cable linkage length or geometry. The throttle plate comprises a plate having apertures to accommodate pre-existing connectors and a perimeter that corresponds to connections between, and the geometry of, the carburetor or throttle body and intake manifold. The plate fits between the carburetor or throttle body and intake manifold and defines at least one airflow hole corresponding to the airflow path in the carburetor or throttle body. If there are multiple airflow paths between the carburetor or throttle body and intake manifold, then there will be multiple airflow holes. One or more vanes integral with the plate extend radially from the perimeter of each airflow hole toward its center. The plurality of vanes can be a variety of shapes, including helical and inclined, and extend into the airflow hole only to the extent they work in proximity of the throttle valve(s) and do not obstruct operation of the throttle valve in the throttle body. As air flows from the throttle valve(s) through the throttle plate and into the intake manifold, the vanes redirect laminar airflow into turbulent airflow.

19 Claims, 5 Drawing Sheets

THROTTLE PLATE FOR USE WITH INTERNAL COMBUSTION ENGINE

FIELD OF INVENTION

This invention generally relates to the field of air intake systems for vehicle internal combustion engines. In particular, this invention relates to a throttle plate designed to increase horsepower and fuel efficiency in internal combustion engines.

BACKGROUND

Increasing power and improving fuel efficiency of internal combustion engines is particularly desirable across the population of automobile drivers. One method of increasing power and improving fuel efficiency is to increase the volume of dense air flowing into the combustion chamber of a vehicle's engine. Throttle body spacers, such as the Poweraid® TBS available from Airaid, are designed to create a vortex that spins air to be combusted while maintaining the same pressure differential, which ultimately improves engine efficiency. The greater the efficiency level of the intake system, the greater horsepower output there will be.

Generally, air enters a vehicle's fuel system at the airbox or air intake chamber. In the airbox, there is typically one air filter that is then connected with intake hoses to each carburetor or directly to the throttle body in fuel-injected engines. The throttle body regulates the airflow through the attached intake manifold. The intake manifold directs air or air-fuel mixtures from the throttle body to the intake ports in the cylinder head. The flow typically proceeds from the throttle body into a chamber called the plenum, which in turn feeds individual tubes, called runners, leading to each intake port. Throttle body spacers are inserted between the throttle body or carburetor and the intake manifold and are designed to redirect low velocity laminar airflow into higher velocity turbulent airflow. This spins air to be combusted while maintaining the same pressure differential.

In addition to throttle body spacers, other products marketed as vortex generators include the Turbonator™ available from Turbonator.com Inc. and the Tornado available from Tornado Air Management Systems. Unlike throttle body spacers, these products are inserted into the intake hoses adjacent to the air filter. Because the intake hoses are distant from the intake ports of the engine and do not work in relation to the throttle valve, these vortex generators have little or no effect. Rather, these vortex generators actually obstruct airflow, leading to increased drag and reduced efficiency.

Because throttle body spacers are located between the throttle body and the intake manifold and work in relation to the close proximity of the throttle valve, they are more effective at delivering higher velocity airflow at "part throttle" or partially opened throttle valves. This "part throttle" situation is where most vehicle operation occurs to maintain constant velocity and thus provides functionality during this situation. Unfortunately, while effective, current throttle body spacer designs are cumbersome to install or not optimized for maximum benefit at part throttle. Throttle body spacers for automobiles are generally one to two inches thick in order to either provide adequate surface area along the spacer (e.g. when a helix or similar bore is used) or to avoid interfering with the throttle valve (e.g. when the spacer incorporates protruding components). The additional thickness requires additional brackets, spacers, and other components to correct throttle cable linkage length or geometry. Thinner spacers are available for motorcycles; but those designs do not account for the protruding throttle valve and are not optimized for maximum effectiveness at part throttle positions. It therefore would be desirable to design a throttle body plate with an insubstantial thickness that can be used in the same location as a throttle body spacer. It would also be desirable to design a throttle body plate that does not interfere but rather works in conjunction with the throttle valve and that can be manufactured from a single sheet of material. Finally, it would be desirably to design a throttle plate that works in even closer proximity to the throttle valve when it is at part throttle.

Accordingly, one object of this invention is to provide a throttle plate that does not require extra components to accommodate its thickness. Another object of this invention is to provide a throttle plate that minimizes the distance between its features and a partly open throttle valve to maximize its effectiveness. Another object of this invention is to provide a throttle plate that increases high velocity airflow without obstructing the throttle valve but rather works in conjunction with the position of the throttle valve(s). Another object of this invention is to provide a throttle plate that can be easily manufactured from a single sheet of metal or similar material.

SUMMARY OF THE INVENTION

This invention is a throttle plate for use with internal combustion engines that effectively increases horsepower and improves fuel efficiency in internal combustion engines. The throttle plate of this invention comprises a plate having apertures to accommodate the pre-existing connectors and a perimeter that corresponds to connections between, and the geometry of, the carburetor or throttle body and intake manifold of the vehicle on which it will be installed. The plate fits between the carburetor or throttle body and intake manifold and defines at least one airflow hole corresponding to the airflow path in the carburetor or throttle body. If there are multiple airflow paths between the carburetor or throttle body and intake manifold, then there will be multiple airflow holes. One or more vanes integral with the plate extend radially from the perimeter of each airflow hole toward its center. The vanes can be a variety of shapes, including helical and inclined, and extend into the airflow hole only to the extent they do not obstruct operation of the throttle valve in the throttle body.

When installed in a vehicle between the carburetor or throttle body and intake manifold, air flows from the throttle body through the throttle body spacer and into the intake manifold. The vanes redirect laminar airflow into turbulent airflow by their close proximity to the throttle valve(s) at "part throttle". The throttle plate can be manufactured from sheet metal by first stamping or punching the plate and vanes and then second forming the vanes into a desired shape.

DETAILED DESCRIPTION OF THE INVENTION

Figure 1:
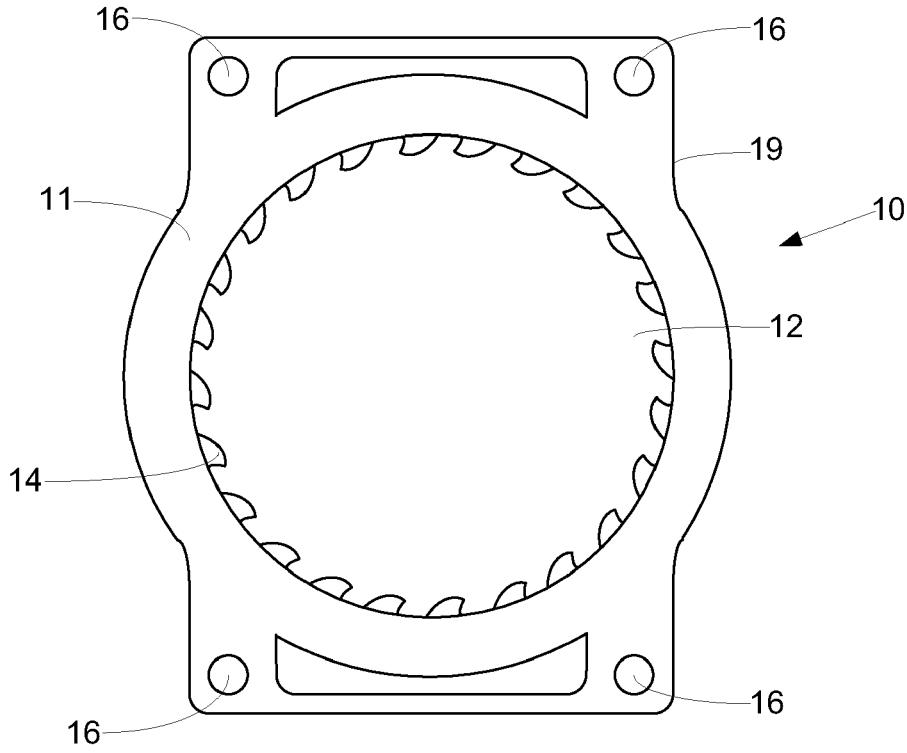
FIG. 1 is top view of the throttle plate of the preferred embodiment of this invention.
Figure 2A:
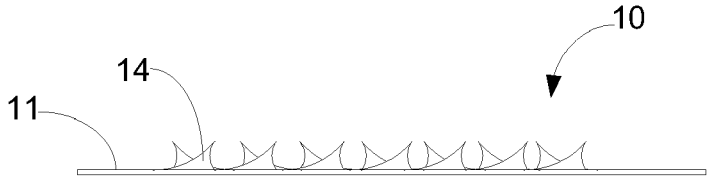
FIG. 2A is a side view of the throttle plate of the preferred embodiment of this invention.
Figure 2B:
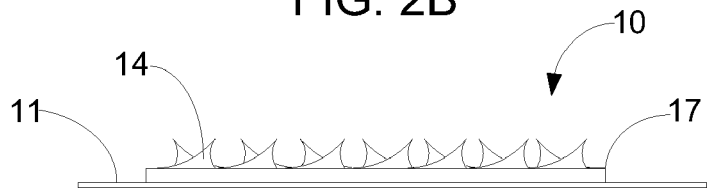
FIG. 2B is a side view of an alternative embodiment of this invention.

This invention is a throttle plate 10 for increasing horsepower and improving fuel efficiency in internal combustion engines. A preferred embodiment of the throttle plate 10 of this invention is shown in FIGS. 1 and 2A. The throttle plate 10 includes a plate 11 that defines an airflow hole 12, and one or more connection holes 16. Vanes 14 are preferably integral with plate 11 and extend from the circumference of airflow hole 12 toward the center of airflow hole 12. Plate 11 is further defined by perimeter 19. FIG. 2B illustrates a second embodiment of this invention incorporating a neck 17 to offset vanes 14 from the plate 11.

Plate 11 can be manufactured from any relatively thin material. Traditionally, throttle body spacers are approximately one inch thick and require extra connectors and spacers to properly position the spacer between the throttle body and intake manifold. In contrast, plate 11 of this invention is of a thickness that does not require additional connectors and spacers when installed between the throttle body and intake manifold. For example, in the preferred embodiment, plate 11 is aluminum of a thickness of 20 gage (0.032 inches). Alternatively, materials such as steel are suitable as well. Other materials having sufficient strength and durability when thin can be substituted as well, as is known in the art.

In the preferred embodiment, airflow hole 12 corresponds to the size of the air path of the throttle body or carburetor to which plate 11 will attach. Typically, airflow hole 12 will be a circular shape with a diameter between 40 mm and 90 mm or between 1.57 inches and 3.55 inches. For example, if the diameter of the air path through the throttle body of an automobile is 40 mm, then the diameter of airflow hole 12 is also 40 mm. Airflow hole 12 can be any shape or size, however, as long as it cooperates with the air path of the carburetor or throttle body and the intake manifold, as is known in the art.

The perimeter 19 of plate 11 also corresponds to the size and shape of the carburetor or throttle body and intake manifold to which plate 11 attaches. In particular, any connection holes 16 correspond to the preexisting points of connection between the carburetor or throttle body and intake manifold. For example, if the throttle body and intake manifold of an automobile are connected with four bolts arranged in a square-like pattern around the throttle body, then perimeter 19 of plate 11 will encompass these connection points, and plate 11 will include connection holes 16 that cooperate with the four bolts arranged in a square-like pattern. This facilitates installation of plate 11 between the throttle body and intake manifold without requiring any additional connectors. Additionally, plate 11 and perimeter 19 can be designed in any shape that allows for clearance of other automobile components as long as it is of a shape and size sufficient to be secured between the carburetor or throttle body and intake manifold of the automobile.

Figure 3A:
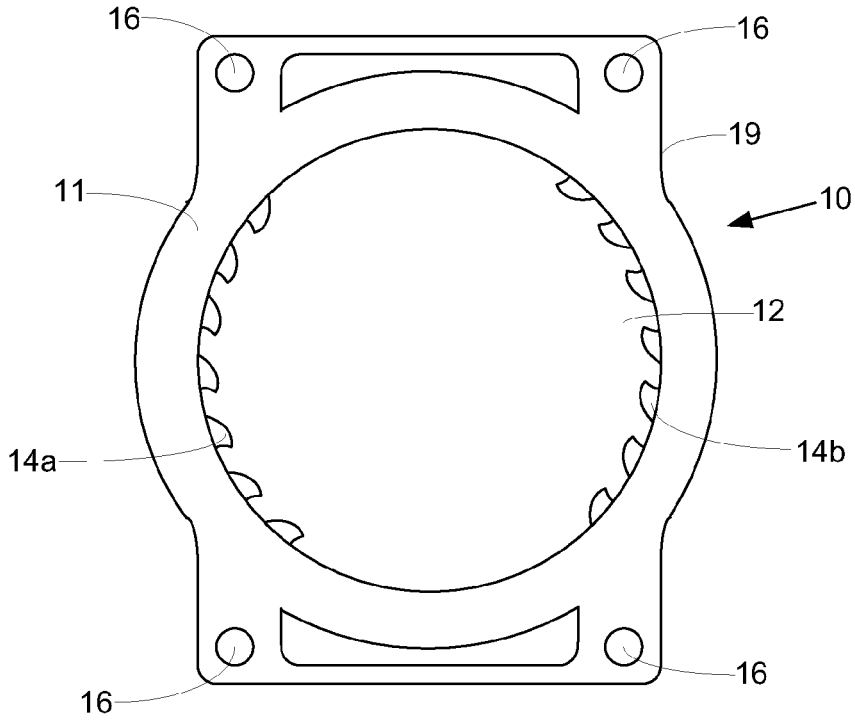
FIG. 3A is a top view of an alternative embodiment of this invention.
Figure 3B:
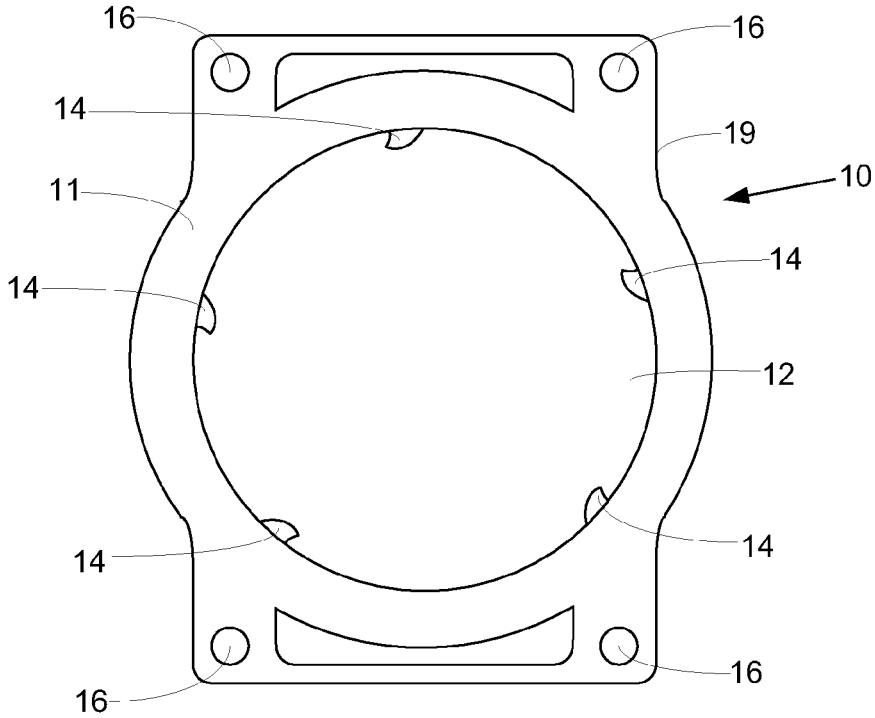
FIG. 3B is a top view of an alternative embodiment of this invention.

Vanes 14 extend radially from the circumference of airflow hole 12 toward the center of airflow hole 12. There can be as few as two vanes or enough vanes to completely surround airflow hole 12. Additionally, the vanes can be evenly distributed around the perimeter or circumference of airflow hole 12 as shown in FIG. 3B or can be clustered or grouped into two or more pluralities of vanes 14*a* and 14*b* as illustrated in FIG. 3A. It is preferred that vanes are evenly distributed around the circumference of airflow hole 12 to best affect the boundary layer of airflow. Vanes 14 are preferably integral with plate 11 and formed from the same sheet of material so that vanes 14 and plate 11 are of uniform thickness. Alternatively, vanes 14 can be attached to plate 11 by any manner of fixing one component to another, as is known in the art.

Vanes 14 can be formed into a variety of shapes as well. In the preferred embodiment, vanes 14 are formed into a helical shape to direct laminar airflow into a swirling airflow pattern. Vanes 14 are bent at a 45 degree angle, with the bend line of each tooth being 45 degrees to the radial position centerline of each tooth. Alternatively, vanes 14 can be an angled, contoured, inclined, curved, airfoil, or twisted shape or any shape that introduces turbulence to the otherwise laminar airflow. The shape of vanes 14 will also impact the length of vanes 14.

Figure 4A:
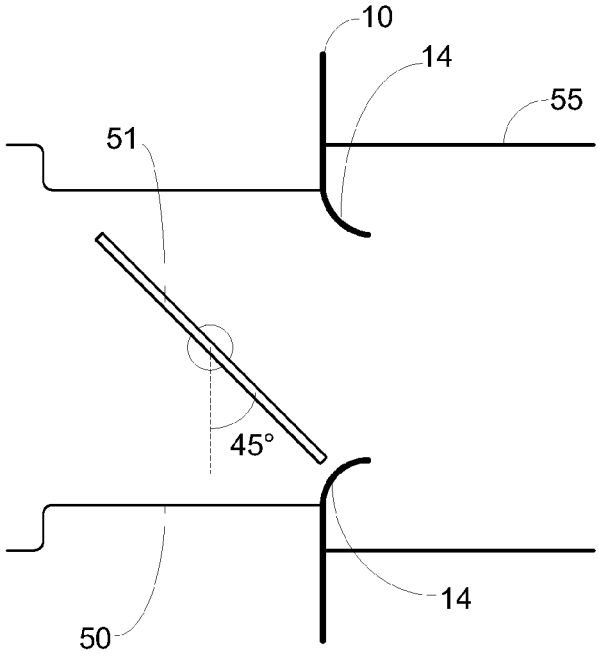
FIG. 4A is an illustration of a throttle blade in close proximity to the preferred embodiment of this invention.
Figure 4B:
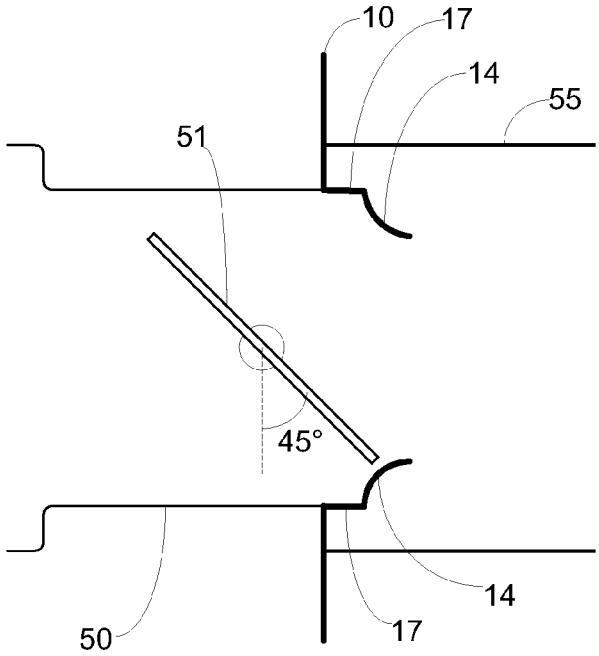
FIG. 4B is an illustration of a throttle blade in close proximity to an alternative embodiment of this invention.

Because plate 11 is relatively thin, the throttle valve may periodically extend into the airflow hole 12. Accordingly, it is important that vanes 14 not extend too far toward the center of airflow hole 12 such that they will interfere with the throttle valve as it rotates. It is also important, however, that vanes 14 extend far enough so that vanes 14 nearly meet the throttle valve when it is at part throttle. This design enables vanes 14 to stir up the entire volume of air that passes through the throttle plate at partial throttle. FIG. 4A illustrates when the throttle blade is at part throttle and ideally at what throttle position the vanes should be in closest proximity to the throttle valve. When the throttle valve is more open, vanes 14 will continue to stir up the boundary layer air passing on the surface of the throttle body bore. FIG. 4B illustrates when the throttle blade is at part throttle with an alternate embodiment of the throttle plate 10 having a neck 17. Neck 17 shifts vanes 14 further downstream in the intake manifold to allow for vanes 14 to extend further toward the center of airflow hole 12 without interfering with the throttle valve at part throttle. Neck 17 can be integral with plate 11 or attached to plate 11 by any manner of fixing one component to another, as is known in the art. Vanes 14 similarly can be integral with neck 17 or attached by any manner of fixing one component to another, as is known in the art.

In the preferred embodiment, vanes 14 have a radial length between 0.125 inches and 0.204 inches before they are formed into their helical shape. The radial length of the vanes 14 is the distance from the perimeter or circumference of airflow hole 12 radially toward the center of airflow hole 12 before the vanes are bent, twisted, or otherwise manipulated. Preferably, vanes 14 should reduce the size of airflow hole 12 by 10%-17% before they are twisted or bent into their desired shape. Additional design parameters and dimensions are detailed in FIGS. 5A, 5B, and 5C.

Figure 5A:
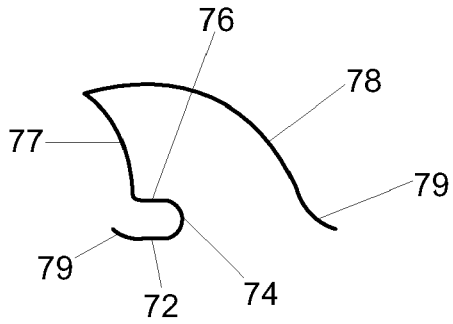
FIG. 5A is an illustration of a vane of the present invention.

FIG. 5A illustrates the shape of an individual vane. As shown in FIG. 5A, each vane includes a notch comprising a first notch section 72, a second notch section 74, and a third notch section 76. First notch section 72 extends along the perimeter of the airflow hole 12. First notch section 72 connects to second notch section 74, which extends toward the center of airflow hole 12 and is defined by half of the circumference of a circle. Second notch section could alternatively any portion of a circle greater than one quarter of a circle's circumference and less than half of a circle's circumference. Second notch section 74 then connects to third notch section 76, which extends parallel to first notch section 72. Third notch section 76 then connects to lower vane curve 77. Lower vane curve 77 extends toward the center of airflow hole 12 and is defined by a curve segment with a first radius. Upper vane curve 78 connects to lower vane curve 77. Upper vane curve 78 first extends toward the center of airflow hole 12 and then second extends back toward the perimeter of airflow hole 12. Upper vane curve 78 is defined by a curve segment with a second radius. Upper vane curve 78 then connects to notch curve 79, which connects upper vane curve 78 to notch section 72 of the adjacent vane or to the perimeter of airflow hole 12 if there is no immediately adjacent vane. Notch curve 79 preferably is defined by a curve segment with a third radius. Alternatively, notch curve 79 can be any shape that connects upper vane curve 78 to perimeter of airflow hole 12 or an adjacent vane.

Figure 5B:
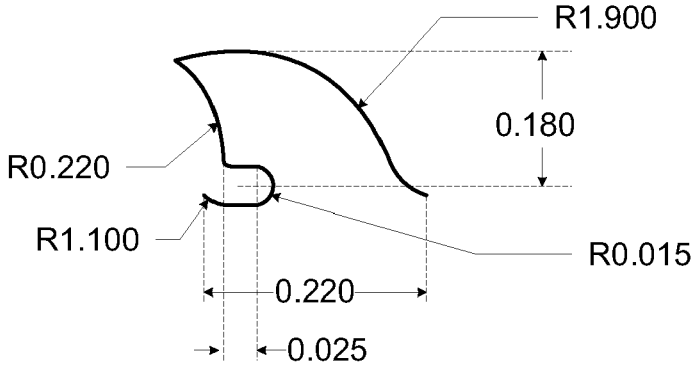
FIG. 5B is an illustration of a small vane of the present invention.
Figure 5C:
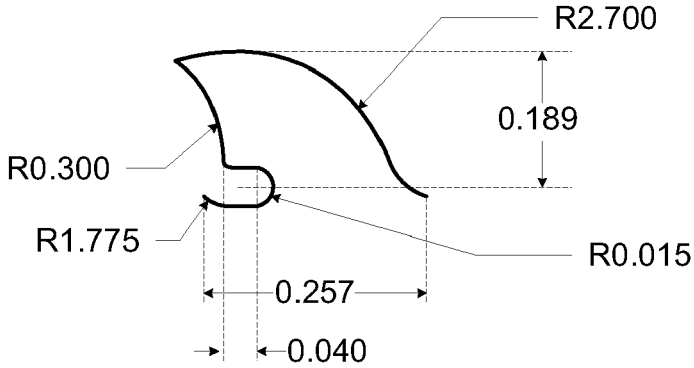
FIG. 5C is an illustration of a large vane of the present invention.

FIGS. 5B and 5C provide dimensions for two sizes of an individual vane. The dimensions are in inches with a tolerance of ±0.005 inches. FIG. 5A illustrates vanes 14 for use with an airflow hole 12 having a diameter of 2.2 inches or 55.88 mm. In this embodiment, 35 vanes surround the circumference of the airflow hole, and the vane's length as defined above is slightly greater than 0.18 inches and is 16.5% of the radius of airflow hole 12. FIG. 5B illustrates vanes 14 for use with a larger airflow hole 12 having a diameter of 3.5 inches or 89.89 mm. For this embodiment, 52 vanes surround the circumference of the airflow hole, and the vane's length as described above is slightly smaller than 0.20 inches and is 10.89% of the radius of airflow hole 12.

Figure 6:
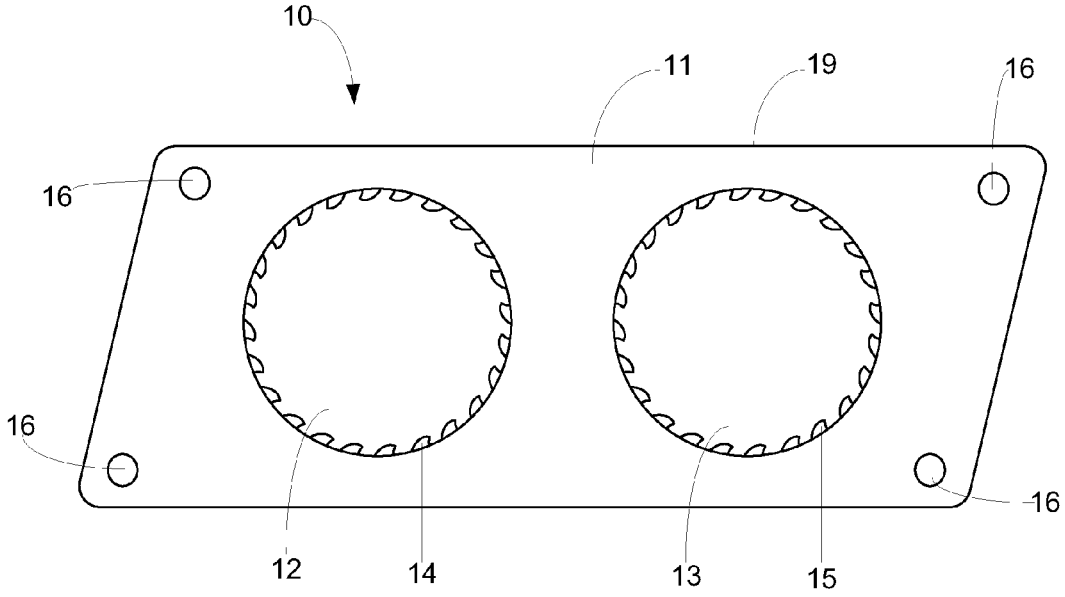
FIG. 6 is a top view of an alternative embodiment of this invention.

FIG. 6 illustrates an alternative embodiment of throttle body spacer 10 where plate 11 defines a first airflow hole 12 and a second airflow hole 13. Plate 11 may additionally define third and fourth airflow holes as well. Plate 11 can define any number of airflow holes depending on the design of an automobiles throttle body and intake manifold. If an automobile has more than one air path through the throttle body and into the intake manifold, plate 11 will have corresponding airflow holes. Additionally, each airflow hole will have one or more vanes. As shown in FIG. 6, first airflow hole 12 includes a first plurality of vanes 14 and second airflow hole 13 includes a second plurality of vanes 15. Vanes 14 and 15 can be uniformly distributed or situated in groups around airflow holes 12 and 13, as described above. Additionally, vanes 14 and 15 can be any shape and size as long as they remain in close proximity to the blade(s) with out interference as described above, introduce turbulent airflow, and do not interfere with the throttle valves.

Figure 7:
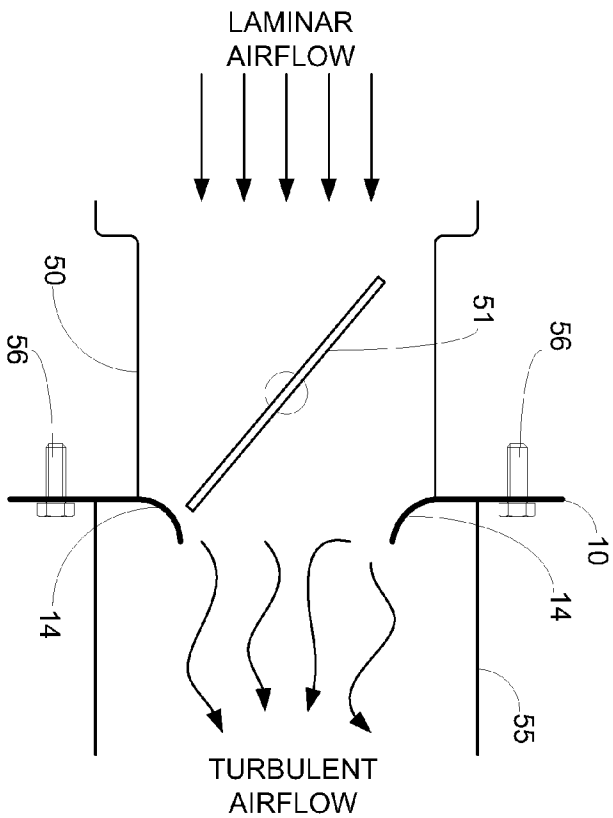
FIG. 7 is a cross-sectional view of the fuel system of an internal combustion engine showing the throttle plate as it is installed between the carburetor or throttle body and intake manifold.

FIG. 7 illustrates how throttle plate 10 is positioned along an internal combustion engine's fuel system. Throttle plate 10 is connected to the intake manifold 55 and throttle body 50 with connectors 56. Air flows through the throttle body 50, which houses the throttle valve 51. Air then flows through throttle body valve(s) and throttle plate vanes 10 and into the intake manifold 55. FIG. 7 illustrates the importance of limiting the length of vanes 14 so that they do not interfere with throttle valve 51. Additionally, FIG. 7 illustrates how, as air flows through throttle plate 10 and across vanes 14, laminar airflow becomes turbulent. In general, turbulence is created when the throttle valve is partly open or at a position less than wide-open and a low pressure area is created behind the throttle valve. The spinning effect caused by the throttle plate disrupts laminar air flow and minimizes the low pressure area behind the throttle valve. This minimized pressure differential equates to additional volume of air that is passing through the carburetor or throttle body at the same throttle valve angle, therefore providing greater power gains and efficiency. These gains are realized by the vehicle operator experiencing increased efficiency and power levels from what was previously experienced by applying more throttle.

Because throttle plate 10 is relatively thin and because vanes 14 are preferably integral with plate 11, throttle body plate 11 can be manufactured from sheet metal. To manufacture throttle plate 10, first a blank or pre-form of the shape is made. For example, the overall shape of the plate 11, including vanes 14 before they are twisted or manipulated, can be punched or stamped from the sheet and the extra material discarded or recycled. Next, vanes 14 are formed into their desired shape. For example, if vanes 14 are to be inclined or angled, then vanes 14 are bent accordingly. Likewise, if vanes 14 are to be helical shaped, then they are twisted accordingly. Finally, any finishing work can be done to conform to precise dimensions or specifications.

While there has been illustrated and described what is at present considered to be the preferred embodiment of the present invention, it will be understood by those skilled in the art that various changes and modifications may be made and equivalents may be substituted for elements thereof without departing from the true scope of the invention. Therefore, it is intended that this invention not be limited to the particular embodiment disclosed, but that the invention will include all embodiments falling within the scope of the appended claims.

We claim:

1. A throttle plate comprising:

a. a plate defining at least one airflow hole for installation between a vehicle's throttle body and intake manifold; and b. one or more vanes integral with the plate and extending radially from the perimeter of the airflow hole toward the center of the airflow hole, wherein the radial length of each vane is over 10 percent of the radius of the airflow hole and wherein each vane comprises a notch, a lower vane curve, and an upper vane curve.

2. The throttle plate of claim 1 wherein each vane is bent at a 45 degree angle.

3. The throttle plate of claim 1 wherein each vane is formed into a helical shape.

4. The throttle plate of claim 1 wherein the radial length of each vane is less than 17 percent of the radius of the airflow hole.

5. The throttle plate of claim 1 comprising a plurality of vanes that are evenly distributed around the circumference of the airflow hole.

6. The throttle plate of claim 1 comprising two or more plurality of vanes.

7. The throttle plate of claim 1 wherein the radial length of each vane is between 0.18 and 0.20 inches.

8. The throttle plate of claim 1 wherein the airflow hole comprises a diameter between 40 and 90 mm.

9. The throttle plate of claim 1 wherein the plate defines a first airflow hole and a second airflow hole and wherein a first plurality of vanes radially extends from the perimeter of the first airflow hole and toward the center of the first airflow hole and wherein a second plurality of vanes radially extends from the perimeter of the second airflow hole and toward the center of the second airflow hole.

10. The throttle plate of claim 1 wherein the plate is 0.032 inches thick.

11. The throttle plate of claim 9 wherein the first plurality of vanes comprises vanes having a radial length between 10 and 17 percent of the radius of the first airflow hole and wherein the second plurality of vanes comprise vanes having a radial length between 10 and 17 percent of the radius of the second airflow hole.

12. The throttle plate of claim 9 wherein the first plurality of vanes comprises vanes having a radial length between 0.18 and 0.20 inches and wherein the second plurality of vanes comprise vanes having a radial length between 0.18 and 0.20 inches.

13. The throttle plate of claim 1 further comprising one or more apertures to accommodate connectors.

14. The throttle plate of claim 1 wherein the plate further comprises a perimeter that cooperates with the connections between an automobile's throttle body and intake manifold.

15. The throttle plate of claim 1 wherein the plate further comprises a neck.

16. The throttle plate of claim 15 wherein the vanes extend from the neck toward the center of the airflow hole.

17. A method of increasing air turbulence in an internal combustion engine's intake manifold comprising introducing air through a throttle body past the throttle valve(s), into a throttle plate defining an airflow hole, and one or more radially extending vanes wherein the radial length of each vane is over 10 percent of the radius of the airflow hole and wherein each vane comprises a notch, a lower vane curve, and an upper vane curve.

18. The method of claim 17 wherein the radial length of each vane is less than 17 percent of the airflow hole.

19. The method of claim 17 wherein each vane is formed into a helical shape.

* * * * *